United States Patent [19]

Jerome

[11] 4,221,029

[45] Sep. 9, 1980

[54] BINDING STRAP FASTENER

[76] Inventor: Susanne M. Jerome, 1540 E. Griswold Rd., Phoenix, Ariz. 85020

[21] Appl. No.: 950,474

[22] Filed: Oct. 11, 1978

[51] Int. Cl.[2] ..... A44C 5/18

[52] U.S. Cl. ..... 24/265 R; 24/182

[58] Field of Search ..... 24/163 R, 265 EC, 265 BC, 24/265 AL, 182, 183; 54/28

[56] References Cited

U.S. PATENT DOCUMENTS

| | | | |
|---|---|---|---|
| 579,899 | 3/1897 | Scurr | 24/182 |
| 615,342 | 12/1898 | Brockman | 54/28 |
| 703,584 | 7/1902 | Hodges | 24/164 |
| 986,362 | 3/1911 | Cohen | 24/183 |
| 1,879,682 | 9/1932 | Heinze | 24/183 |
| 2,257,700 | 9/1941 | Meehan | 24/182 |
| 2,379,128 | 6/1945 | Wilson | 24/182 |
| 2,495,029 | 1/1950 | Spengler | 24/182 |

FOREIGN PATENT DOCUMENTS

| | | | |
|---|---|---|---|
| 300901 | 9/1917 | Fed. Rep. of Germany | 24/265 AL |
| 99022 | 5/1923 | Switzerland | 24/265 AL |

*Primary Examiner*—J. Franklin Foss

*Attorney, Agent, or Firm*—Cahill, Sutton & Thomas

[57] ABSTRACT

An improved binding strap fastener for attaching crampons (mounting climbing spikes) to mountain climbing boots includes a lever assembly and a retaining clip for retaining the lever assembly in a fastened position. The lever assembly includes a rigid, curved lever plate riveted to a portion of a binding strap. A leading end of the lever assembly is inserted through a "D-ring" attached to a connecting eyelet of the crampons and is forced against the D-ring to tighten the binding strap to a predetermined tension by rotating the lever assembly approximately 180 degrees. The lever assembly then is slid beneath the retaining clip to retain the lever assembly in its fastened configuration. The operations of fastening and unfastening the binding strap can be easily accomplished by a mountain climber wearing heavy mittens without the necessity of removing the mittens from his or her hands.

10 Claims, 8 Drawing Figures

BINDING STRAP FASTENER

BACKGROUND OF THE INVENTION

1. Field of the Invention

The invention relates to binding fasteners, and particularly to binding fasteners enabling a mountain climber wearing heavy mittens to easily attach crampons to hiking boots without the necessity of removing the mittens from his or her hands.

2. Description of the Prior Art

Mountain climbers commonly utilize mountain climbing spikes, hereinafter referred to as crampons, fastened to their hiking boots by means of an assembly of bindings. The crampons commonly include a pair of horizontal hinged rails having a plurality of vertical spikes attached thereto. A plurality of eyelets or slotted openings are utilized to effect attaching of binding straps passing over the toe and upper portions of the hiking boots to the crampons. "D-rings" or the like passing through the eyelets are commonly used to engage the binding straps. The straps are passed through the D-ring loops; various buckles and slip rings are utilized to adjust the tension of the binding straps and securely fasten or grip the binding straps to prevent slippage. Various traction-increasing cleats, spikes and the like attachable by means of adjustable binders to mountain footwear or to vehicle tires are shown in U.S. Pat. Nos. 2,342,776, 2,588,801, 2,207,401, 754,577, 2,679,882 and 2,682,907. Only conventional latching and buckling devices are disclosed in the above patents for attaching the various traction-increasing devices. All of the various buckling and latching means have the shortcoming that it would be very difficult for a person wearing heavy mittens to either fasten or unfasten the buckles and/or fastening devices without removing his or her mittens.

It is frequently highly desirable that a mountain climber be able to remove his crampons or fasten them to his hiking boots without removing heavy mittens. Mountain climbers frequently encounter very cold, windy weather conditions. Further, it is frequently necessary for a mountain climber to unfasten his crampons for a number of reasons. For example, after ascending a steep crusted snow slope requiring crampons to ensure secure footing, the mountain climber may encounter a steep, rocky region next to be traversed. The mountain climber would ordinarily like to remove the crampons in order to more comfortably and safely climb the steep rocky region. However, under adverse weather conditions, he could increase the chance of frostbite to his fingers if it were necessary for him to remove his mittens in order to unfasten his crampons. And, of course, crampons must be removed before a mountain climber enters a mountain tent in order to avoid damage to the tent.

Accordingly, it is an object of the invention to provide a binding strap fastener which can be easily fastened or unfastened without the exercise of the amount of manual dexterity required by binding strap fasteners of the prior art.

It is another object of the invention to provide a strap fastener which can be readily fastened or unfastened by a person wearing heavy mittens.

It is another object of the invention to provide a crampon binding strap and fastener which is easily fastened and unfastened by a mountain climber wearing heavy mittens.

U.S. Pat. Nos. 2,686,920 and 3,407,452 show various belt buckles. However, such buckles are not readily suitable for application to binding straps for crampons, since manual dexterity is required to utilize such buckles.

A crampon binding manufactured by Mountain Safety Research Corporation, shown on pages 13–19 of Issue 13 (April, 1978) *Mountain Safety Research Catalogue and Newsletter*, is presently believed to disclose the closest prior art binding fastener. That binding fastener includes a hinged closed loop or ring through which a flexible binding strap is passed. The closed ring then swings against a serrated edge which bites into the flexible strap to prevent slippage. The strap is then bent sharply back against the serrated edge and slid laterally beneath a first overhanging retaining tab and is then flexed in an opposite direction and slid under an oppositely oriented second retaining tab. The Mountain Safety Research fastener has a primary disadvantage in that it is practically impossible to unfasten the device when wearing heavy mittens. It has the further shortcoming that a binding strap must be pulled tightly to establish the desired tension of the binding strap before the binding strap is bent back against the serrated edge and slid under the two retaining tabs. The foregoing device has a further shortcoming in that if the binding strap material in the vicinity of the serrated edge strikes a rock, twig, hard snow crust, or the like, the resulting jolt may cause some slippage of the binding strap past the teeth of the serrated edge, loosening the bindings, and possibly endangering the mountain climber.

It is therefore yet another object of the invention to provide a crampon binding and fastener which is not susceptible to slippage or inadvertent unfastening due to being struck by snow crusts, rocks, twigs, and the like.

Yet another object of the invention is to provide a crampon binding system which can be readily unfastened and/or refastened without changing a predetermined binding strap tension adjustment of the binding system when it is in the fastened configuration.

SUMMARY OF THE INVENTION

Breifly described, and in accordance with one embodiment thereof, the invention provides a binding strap fastening system including a lever element connected to a first point of a binding strap for fastening the binding strap to a connecting element and a lever element retainer for clamping the lever element into a configuration wherein the lever element is hinged back about the connecting element to lie approximately against a tensioned portion of the binding strap.

In one embodiment of the invention, the connecting element is a D-ring connected to one side of a crampon and the binding strap is a binding strap connected to an opposite side of the crampon. The fastening system is utilized to securely fasten the crampon to a mountain climbing boot. The lever element includes a rigid aluminum plate curve slightly to conform approximately to the curvature of the binding strap when it is tightened over an upper portion of the mountain climbing boot. A portion of the binding strap is riveted to the curved aluminum plate such that the portion of the binding strap lies snugly against both opposed major surfaces of the curved aluminum plate, forming a lever assembly including the curved aluminum plate and the portion of the binding strap attached thereto. A short end portion of the binding strap extends beyond a pivot end of the curved element of the plate. The lever assembly which pivots about the D-ring contacts the short end portion of the binding strap.

In order to fasten the binding strap to the D-ring, the lever assembly is inserted through the D-ring so that the portion of the binding strap attached to the concave surface of the curved aluminum plate contacts the D-ring. The user presses the outer end of the lever assembly against the D-ring to ply or force the D-ring and the binding strap together. The D-ring slides along the interior concave surface of the lever assembly to the inner end of the curved aluminum plate and pivots about the short end portion of the binding strap. The user continues to turn the lever about the pivot point until it has rotated approximately 180° from its initial position. The user then slips the lever assembly under the retaining clip is a stiff aluminum element attached to the underside of the tension portion of the binding strap and extending vertically upward from an edge of the tensioned portion of the binding strap and over the top of the tensioned portion of the binding strap at a distance above the upper surface of the tensioned portion of the binding strap sufficient to accommodate the lever assembly. A downwardly extending retaining flange having an upwardly extending lip extends from the upper portion of the retaining clip. To slip the lever assembly under the retaining clip, the user moves the lever assembly laterally, pushes the lever assembly under the lip, and forces the lever assembly against the side of the clip so that the lever assembly is aligned with the tensioned portion of the strap. The lever assembly then slips past the retaining flange. The retaining flange thus prevents lateral movement of the lever assembly unless the user applies upward force against the lip of the retaining clip. The amount of tension produced in the binding strap by the foregoing operation is predetermined by adjusting a slip ring or slider type adjusting element which adjusts the length of the end of the binding strap attached to the opposite side of the crampon.

In other embodiments of the invention, the fastener is utilized in conjunction with binding straps for other types of devices than crampons. The fastener is especially useful for fastening snowshoe bindings and backpack waistbands under adverse weather conditions.

DESCRIPTION OF THE INVENTION

Figure 1:
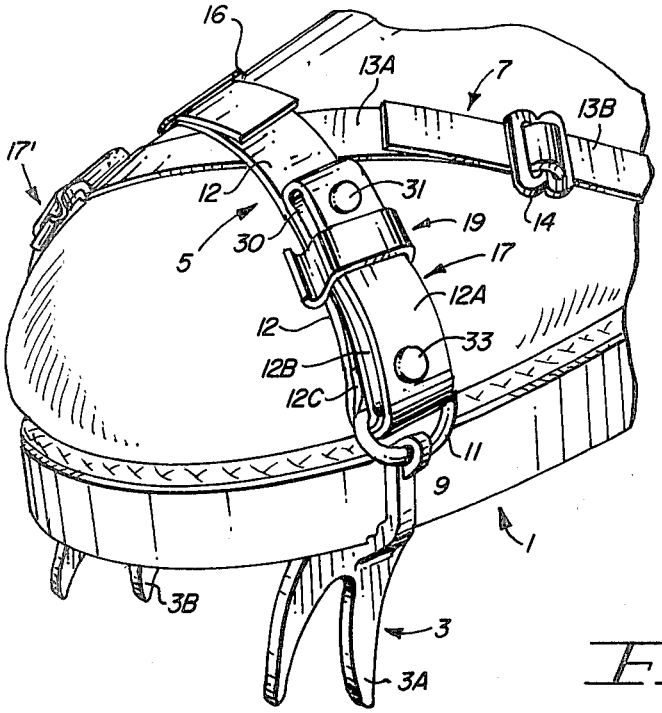
FIG. 1 is a partial perspective view showing a binding strap fastener attaching a crampon to the toe of a hiking boot.
Figure 2:
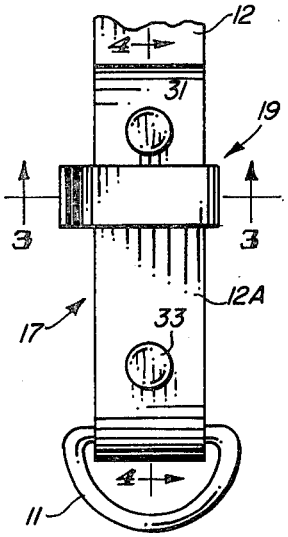
FIG. 2 is a plan view of the fastener of FIG. 1.
Figure 6:
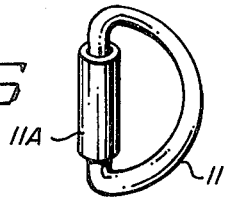
FIG. 6 illustrates an alternate embodiment of the D-ring of FIG. 1.

Referring to FIG. 1, hiking boot 1 has a crampon (previously described), designated by reference numeral 3, attached thereto by means of a plurality of binding straps. Crampons of the type shown on pages 13–19 of issue 13 (April, 1978) of the *Mountain Safety Research Catalogue & Newsletter* can be readily utilized. Crampon 3 includes a plurality of spikes including spikes 3A and 3B and a plurality of other spikes (not shown in FIG. 1). Eyelet 9 is rigidly connected to crampon 3. D-ring 11 is looped through eyelet 9. Binding strap assembly 5, which includes binding strap 12, slider 16 and fastener 17, is connected to a D-ring and crampon eyelet (not shown) on the hidden side of boot 1. Fastener 17 is utilized to tighten binding strap 12 against D-ring 11, thereby securing crampon 3 to the bottom of boot 1. As will be subsequently explained, slider 16 is utilized to adjust the length of a tensioned portion of strap 12 before fastener 17 is fastened.

Binding strap assembly 7 including binding strap 13A, 13B, slider 14 and fastener 17' is connected to a D-ring and crampon eyelet which are located toward the heel of boot 1 but not shown in the partial view of FIG. 1. A second strap fastener 17', only partially shown in FIG. 1, is connected to an eyelet extending up from prong 3B on the hidden side of boot 1, and tightens a section of strap extending to slider 14, which is identical to slider 16.

The details of strap fastener 17 can be best understood by referring to FIGS. 1–4 while reading the following description. Fastener 17 includes a rigid, slightly curved aluminum lever plate 30 sandwiched between portions of strap 12. Strap 12 is preferably made from nylon reinforced neoprene, rather than nylon strap material or leather, because in extremely cold weather nylon may become water soaked and may then freeze, becoming stiff and possibly cracking; leather also absorbs water, and has the further disadvantages that it stretches severely when wet.

Figure 3:
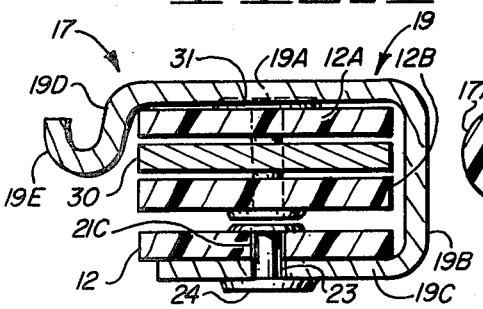
FIG. 3 is a section view taken along section lines 3—3 of FIG. 2.
Figure 4:
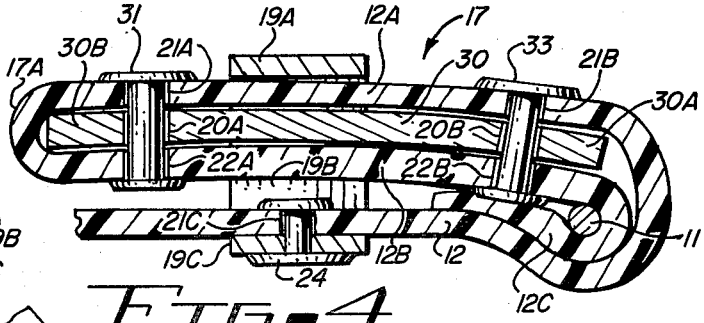
FIG. 4 is a sectional view taken along sections 4—4 of FIG. 2.

Referring particularly to FIGS. 3 and 4, a portion of strap 12 designated by reference numeral 12A extends from pivot end 30A of lever plate 30 along the convex major surface thereof to leading end 30B of lever plate 30; Binding strap 12 passes around leading end 30B and a portion designated 12B extends along the concave major surface of lever plate 30 to pivot end 30A. An additional portion 12C of binding strap 12 extends from lever plate 30 around D-ring 11 when fastener 17 is in its fastened configuration. Strap portions 12A and 12B are securely held against the convex and concave surfaces of lever plate 30 by means of rivet 31, which extends through holes 21A, 20A and 22A of upper strap portion 12A, lever plate 30, and lower strap portion 12B, respectively, and also by means of rivet 33, which extends through holes 21B, 20B and 22B in upper strap portion 12A, lever plate 30 and lower strap portion 12B, respectively. The portion of strap fastener 17 including lever plate 30, upper strap portion 12A and lower strap portion 12B is hereinafter referred to as lever assembly 12A, 30, 12B.

Fastener 17 further includes a lever assembly retaining clip 19. Retaining clip 19 includes a lower portion 19C, a side portion 19B, a top portion 19A, a downwardly oriented retaining flange 19D, and an upwardly oriented lip 19E. Retaining clip 19 is securely fastened to binding strap 12 by means of rivet 24 extending through hole 21C of binding strap 12 and hole 23 in lower portion 19C of retaining clip 19.

When fastener 17 is fastened, lever assembly 12A, 30, 12B is retained as shown in FIGS. 3 and 4 by retaining clip 19. Upper portion 19A of retaining clip 19 prevents upward movement of lever assembly 12A, 30, 12B and side portions 19B and retaining flange 19D of retaining clip 19 prevent lateral movement of lever assembly 12A, 30, 12B. As subsequently explained, lip 19E facilitates both fastening and unfastening of fastener 17.

Figure 5A:
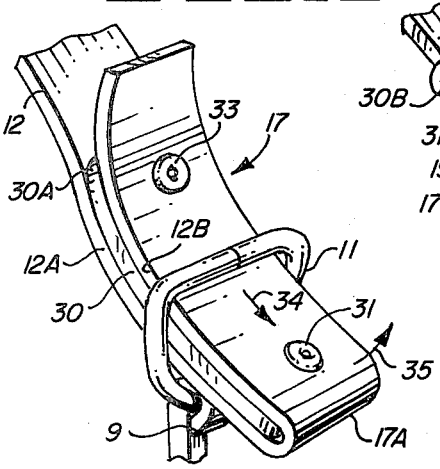
FIGS. 5A–5C show a sequence of perspective views useful in describing the operation of the fastener of FIG. 1.
Figure 5B:
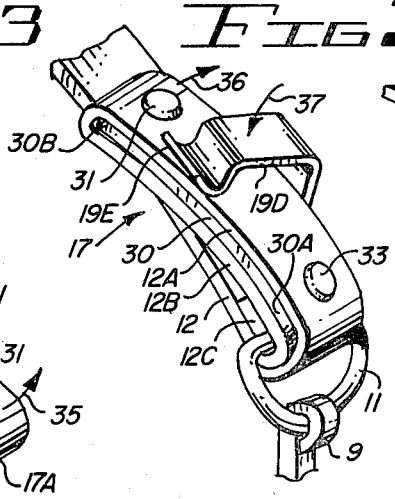
Figure 5C:
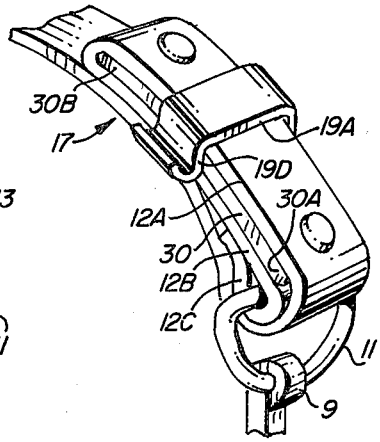

The operation of fastener 17 is best understood by referring to FIGS. 5A–5C. Leading end 17A of lever assembly 12A, 30, 12B is inserted through the opening of D-ring 11 in the direction indicated by arrow 34 in FIG. 5A. This increases the tension on binding strap 12. As the tension on binding strap 12 increases, the user lifts leading end 17A upward in the direction indicated by arrow 35 in FIG. 5A, rotating lever assembly 12A, 30, 12B about D-ring 11. This produces leverage which increases the tension on binding strap 12 as the concave surface of strap portion 12B is pivoted about the straight side of D-ring 11. Pressure applied by the user on leading end 17A in the direction of arrow 35 is continued until lever assembly 12A, 30, 12B has rotated approximately 180°. Lever assembly 12A, 30, 12B is first pushed laterally to the left (as viewed in FIG. 5B) so that lever assembly 12A, 30, 12B can be slid under lip 19E of retaining clip 19. Lever assembly 12A, 30, 12B is then pushed laterally against the sloped lower surface of lip 19E of retaining clip 19 in the direction indicated by arrow 36. This pushes retaining clip 19 upward and pushes strap section 12A downward so that the upper surface of strap section 12A slides under lip 19E. By continuing to press the lever assembly in the direction indicated by arrow 36, and rotating the lever assembly slightly, the entire lever assembly is squeezed through the gap between retaining flange 19D and strap 12, as shown in FIG. 5B. After the lever section has been slid completely past flange 19D into the region bounded by retaining clip 19, retaining flange 19D prevents the lever assembly from escaping therefrom unless the user deliberately lifts lip 19E, thereby slightly rotating retaining clip 19 clockwise with respect to the lever assembly, while pushing the lever assembly downward and to the left, as viewed in FIGS. 5B and 5C. Otherwise, the fastener 17 remains fastened, as shown in FIG. 5C. The unfastening operation is initiated by lifting lip 19E of lever retainer 19 and simultaneously pushing the lever assembly out through the gap between strap 12 and the lower rounded portion of lever retainer 19 between retaining flange 19D and lip 19E. The lever assembly is then rotated clockwise approximately 180° and withdrawn from D-ring 11.

It can be readily seen that far less manual dexterity is required to perform the above described fastening and unfastening processes than is required for buckling and/or unbuckling conventional buckles, since no precise alignments of elements are required. The user can thus perform the above described fastening and unfastening processes using only a single hand with a heavy mitten thereon.

Since the effective length of binding strap 12 has been previously determined by adjustment of slider 16 in FIG. 1, the leverage obtained by rotating the lever assembly counterclockwise as indicated by arrow 35 in FIG. 5A produces the desired amount of tension on binding strap 12 without the need for tugging the strap with an amount of force equal to the desired tension and engaging some type of intricate holding device which bites into or extends through a hole in the strap material during the fastening operation, as required by the known prior art binding fasteners.

In the present embodiment of the invention, lever plate 30 is preferably formed from 1/16" thickness grade 60–61 T6 aluminum alloy material manufactured by Reynolds Aluminum Company and others. Best results have been found if the radius of the bend between retaining flange 19D and upper portion 19A of retaining clip 19 has a radius of approximately 3/16" and if the bend extends for nearly 90°.

While the invention has been described with reference to a particular embodiment thereof, those skilled in the art will be able to modify the arrangement of elements without departing from the true scope and spirit of the present invention. For example, it is not essential that binding strap 12 be riveted to lever plate 30. The various adhesive materials could be used to provide the required attachment. Further, it is not absolutely necessary that the strap material extend the complete length of the major convex and concave surfaces of lever plates 30. Similarly, other types of lever retaining clips could be provided. Therefore, the scope of the invention is intended to be limited only with reference to the following claims.

I claim:

1. A strap fastening system for releasably fastening a strap to a connector, said strap fastening system comprising in combination:

a. means for securing a first point of said strap to an object to be held in place by said strap;

b. lever means attached to a second point of said strap for applying force against said connector to draw said strap toward said connector and to increase the tension in said strap when said lever means is rotated about said connector, said lever means having first and second end points, said lever means being rigid from said first end point to said second end point, said lever means having a first surface extending between said first and second end points, a portion of said connector passing from said first end point across said first surface to said second end point during rotating of said lever means; and c. lever retaining means connected to said strap for releasably retaining said lever means approximately against a portion of said strap between said first and second points after said rotating, said connector engaging said lever means adjacent said second end point while said lever means is retained by said lever retaining means.

2. The strap fastening system of claim 1 wherein said lever means includes a rigid metal strip attached to said first point of said strap.

3. The strap fastening system of claim 2 wherein a first portion of said strap is attached to a first major surface of said metal strip, a second portion of said strap is attached to a second major surface of said metal strip, and a third portion of said strap adjacent said second portion of said strap extends from said metal strip.

4. The strap fastening system of claim 3 wherein said metal strip is curved, said second major surface is concave, and said first major surface is convex.

5. The strap fastening system of claim 4 wherein said strap is composed of nylon reinforced neoprene.

6. The strap fastening system of claim 2 wherein said metal strip is fastened to said strap by means of rivets.

7. The strap fastening system of claim 1 wherein said lever retaining means includes a rigid clip having a bottom portion attached to said strap at a point between said first point and said second point, a side portion extending above said strap, a top portion extending over said strap, and a retaining flange extending downwardly from said top portion leaving a gap between said retaining flange and said strap whereby said lever means may be inserted through said gap to a position over said strap.

8. The strap fastening system of claim 7 further including a lip extending upwardly from the end of said retaining flange.

9. The strap fastening system of claim 1 wherein said retaining clip is composed of rigid metal.

10. The strap fastening system of claim 1 wherein said strap is adjustably connected to said object to adjust the effective length of said strap so that a predetermined tension is produced in said strap when said strap fastening system is fastened.

* * * * *